US008992002B2

(12) United States Patent
Yamamoto

(10) Patent No.: US 8,992,002 B2
(45) Date of Patent: Mar. 31, 2015

(54) LIQUID EJECTION APPARATUS HAVING LIQUID-RECEIVING DEVICES THEREIN

(75) Inventor: Shinya Yamamoto, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 45 days.

(21) Appl. No.: 13/430,941

(22) Filed: Mar. 27, 2012

(65) Prior Publication Data

US 2013/0050373 A1 Feb. 28, 2013

(30) Foreign Application Priority Data

Aug. 31, 2011 (JP) ..... 2011-189046

(51) Int. Cl.
*B41J 2/01* (2006.01)
*B41J 2/17* (2006.01)
*B41J 29/13* (2006.01)

(52) U.S. Cl.
CPC ..... *B41J 2/1721* (2013.01); *B41J 29/13* (2013.01); *B41J 2002/1742* (2013.01)
USPC ..... 347/104; 347/13; 347/33; 347/101

(58) Field of Classification Search
CPC ..... B41J 2/01
USPC ..... 347/13, 33, 104
See application file for complete search history.

(56) References Cited

U.S. PATENT DOCUMENTS 7,021,755 B2 * 4/2006 Ogura et al. ..... 347/104
2012/0081490 A1 * 4/2012 Kawabata et al. ..... 347/104

FOREIGN PATENT DOCUMENTS

JP 06278290 * 10/1994 ..... B41J 2/175
JP H06-278290 A 10/1994

* cited by examiner

*Primary Examiner* — Manish S Shah
*Assistant Examiner* — Jeremy Delozier
(74) *Attorney, Agent, or Firm* — Baker Botts L.L.P.

(57) ABSTRACT

A liquid ejection apparatus includes a head, a receiving device, a holding portion, and a path. The head includes ejection ports that eject a recording liquid onto a recording medium. The receiving device is disposed below the head along a substantially vertical direction and receives recording liquid ejected from the ejection ports. The holding portion is disposed above the receiving device along the substantially vertical direction and holds a recording medium on which the head ejected recording liquid from the ejection ports. The holding portion includes a wall surface. The wall surface includes an opening formed therein. The path guides liquid on the wall surface of the holding portion from the opening in the wall surface of the holding portion to the receiving device. The substantially vertical direction is substantially opposite to a direction of gravity.

13 Claims, 8 Drawing Sheets

LIQUID EJECTION APPARATUS HAVING LIQUID-RECEIVING DEVICES THEREIN

CROSS REFERENCE TO RELATED APPLICATION

This application claims priority to Japanese Patent Application No. 2011-189046, filed Aug. 31, 2011, which is incorporated herein by reference.

BACKGROUND OF THE INVENTION

1. Field of the Invention

The invention relates to liquid ejection apparatus which eject recording liquid, such as ink.

2. Description of Related Art

A known liquid ejection apparatus includes a head, a receiving device, and a holding portion. The head includes a plurality of ejection ports from which recording liquid is ejected. The receiving device is disposed below the head and is configured to receive the recording liquid ejected from the plurality of ejection ports. The holding portion is configured to hold the recording medium which receives the recording liquid ejected from the plurality of ejection ports.

SUMMARY OF THE INVENTION

When the holding portion comprises a wall surface having an opening formed therethrough, a user may spill liquid onto the wall surface of the holding portion, and the liquid may enter the apparatus through the opening. Therefore, a need has arisen for a liquid ejection apparatus which overcomes this shortcoming.

A liquid ejection apparatus disclosed herein may comprise a head, a receiving device, a holding portion, and a path. The head may comprise a plurality of ejection ports configured to eject a recording liquid onto a recording medium. The receiving device may be disposed below the head in a substantially vertical alignment therewith and may be configured to receive at least a portion of the recording liquid ejected from the ejection ports. The holding portion may be disposed above the receiving device in the substantially vertical alignment therewith and may be configured to hold a recording medium on which the head ejected recording liquid from the ejection ports. The holding portion may comprise a wall surface. The wall surface may comprise an opening formed therein. The path may guide liquid on the wall surface of the holding portion from the opening in the wall surface of the holding portion to the receiving device. The substantially vertical alignment may be substantially parallel to a direction of gravity.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the present invention, needs satisfied thereby, and the objects, features, and advantages thereof, reference now is made to the following descriptions taken in connection with the accompanying drawings.

FIG. 4(*b*) is a front view of the locking mechanism of the inkjet printer, which depicts a state in which movement of the upper housing is not controlled by the locking mechanism.

DETAILED DESCRIPTION OF EMBODIMENTS OF THE INVENTION

Embodiments of the invention now are described in detail with reference to the accompanying drawings.

Figure 1:
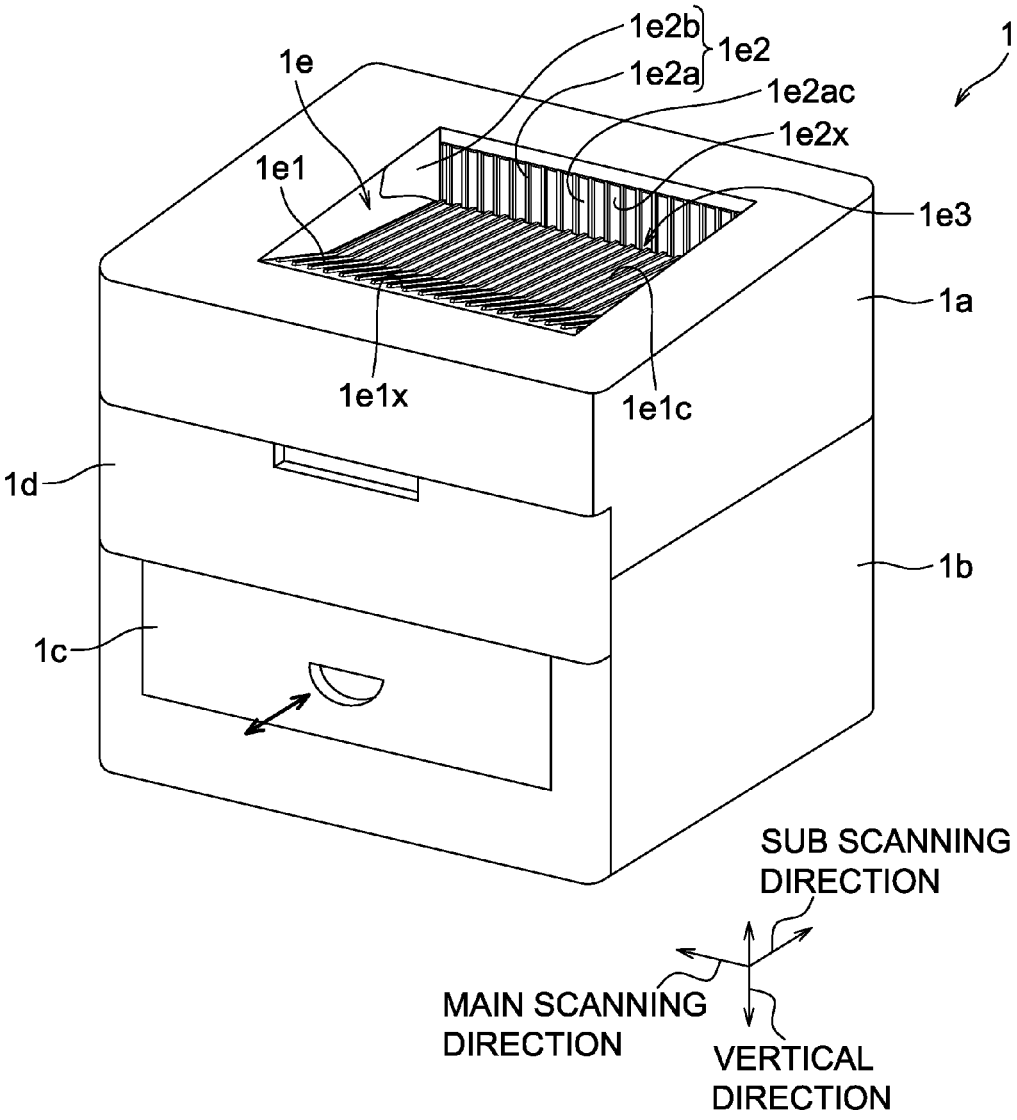
FIG. 1 is an exterior perspective view of an inkjet printer according to an embodiment of the present invention.
Figure 2:
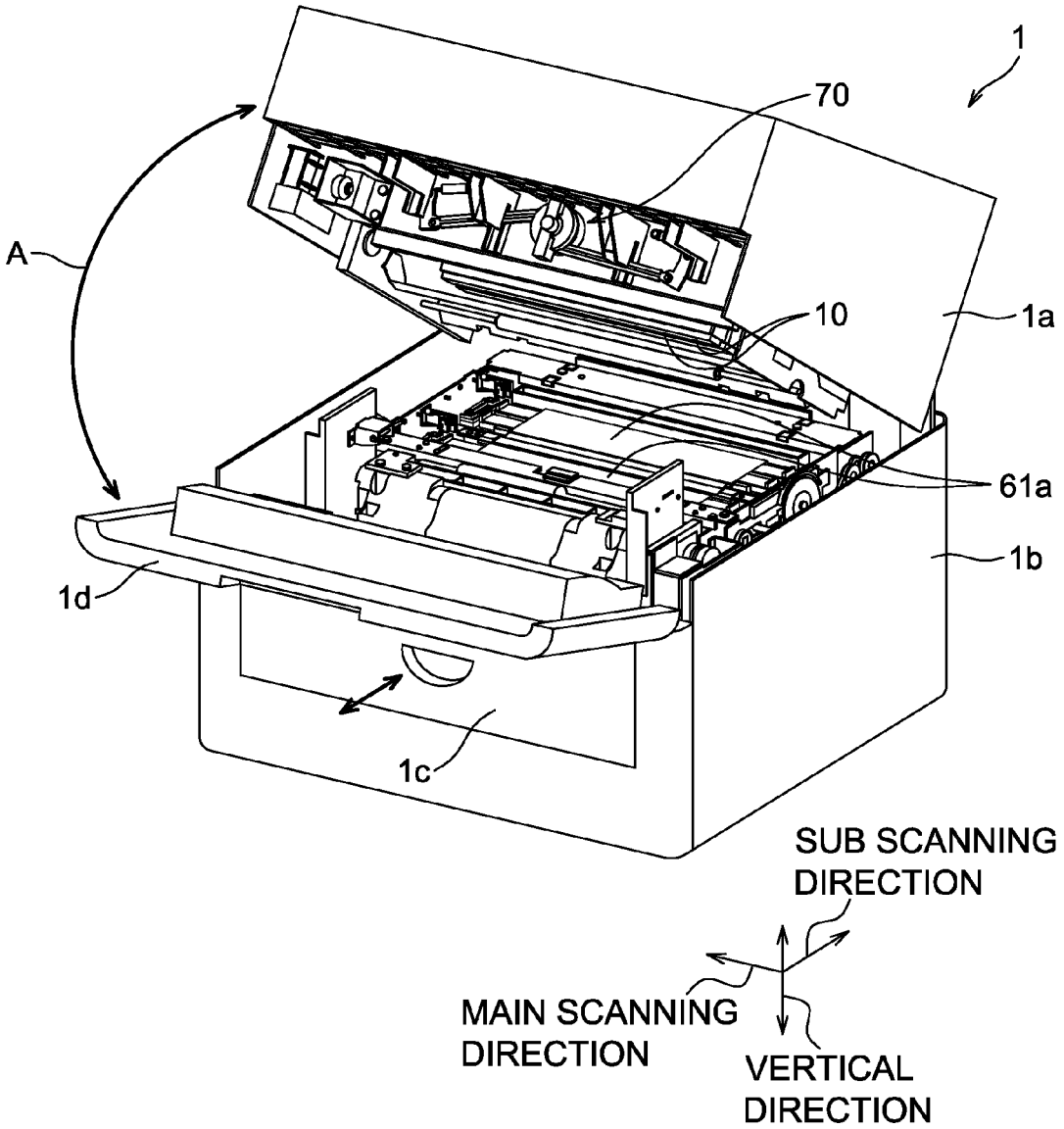
FIG. 2 is an exterior perspective view of the inkjet printer in which an upper housing of the inkjet printer is pivoted with respect to and disposed in a separated position from a lower housing of the inkjet printer.
Figure 3:
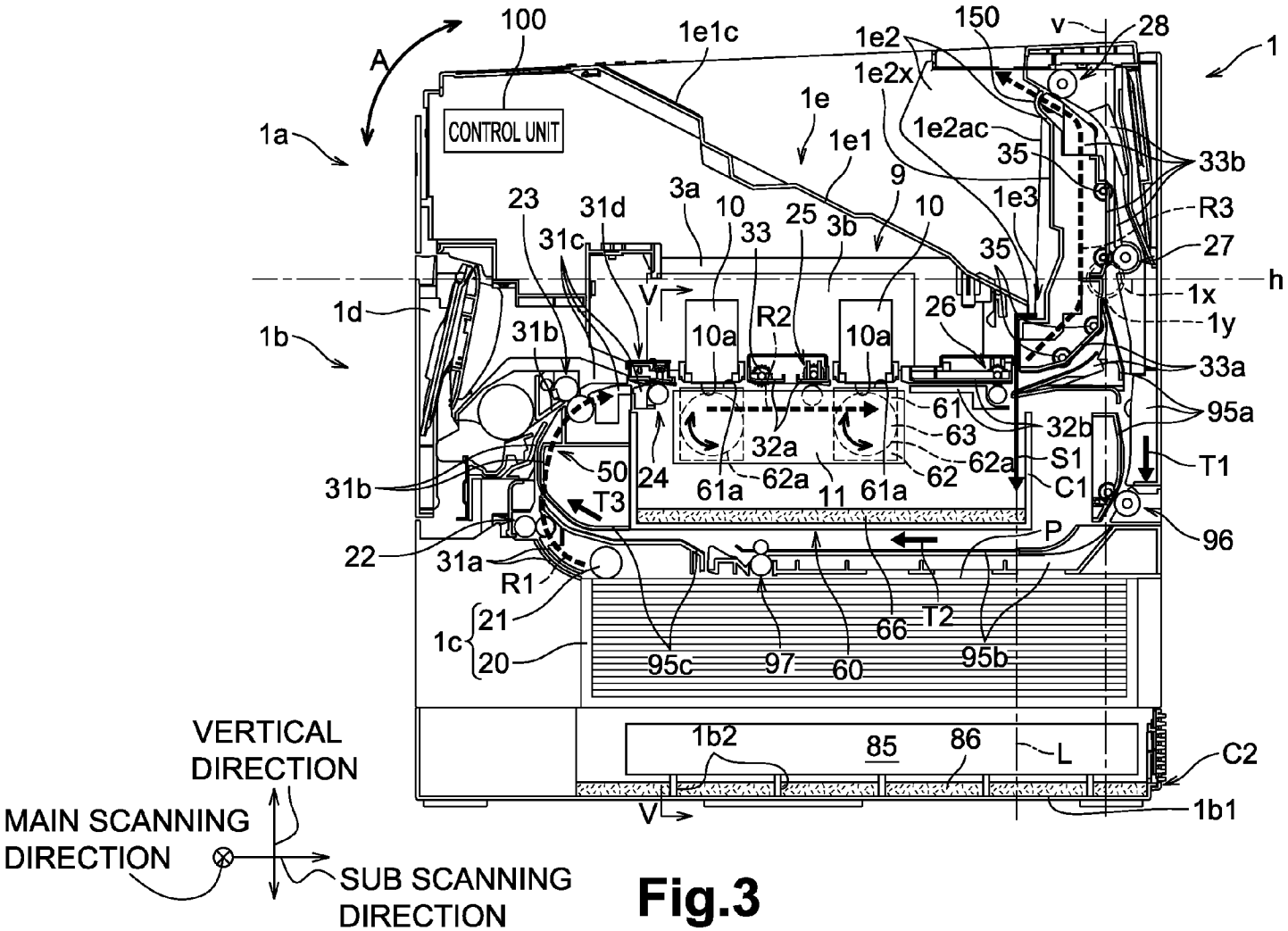
FIG. 3 is a schematic, cross-sectional view of the inkjet printer.

A configuration of an inkjet printer 1 according to an embodiment of the present invention now is described, with reference to FIGS. 1 to 3.

The inkjet printer 1 may comprise an upper housing 1*a* and a lower housing 1*b*. Each of the upper housing 1*a* and the lower housing 1*b* may have a rectangular parallelepiped shape. The upper housing 1*a* may be open at a lower end thereof, and the lower housing 1*b* may be open at an upper end thereof. The upper housing 1*a* may overlap the lower housing 1*b*, which may close the respective openings of the upper housing 1*a* and the lower housing 1*b*. Consequently, an internal space of the inkjet printer 1 may be defined by the upper housing 1*a* and the lower housing 1*b*.

The upper housing 1*a* may comprise an axis of rotation 1*x* along a main scanning direction (e.g., a direction perpendicular to the sheet of FIG. 3). In FIG. 3, the center of the axis of rotation 1*x* may be a point at which a vertical straight line v and a horizontal straight line h intersect. The lower housing 1*b* may comprise a bearing 1*y*, which may support the upper housing 1*a* rotatably on the axis of rotation 1*x*. With this configuration, the upper housing 1*a* may be pivoted in a direction A with respect to the lower housing 1*b* about the axis of rotation 1*x*. This pivoting may allow the upper housing 1*a* to be at a closed position, in which the upper housing 1*a* is close to the lower housing 1*b* (e.g., a position depicted in FIGS. 1 and 3), and at a separated position, in which a portion of the upper housing 1*a* is separated from the lower housing 1*b* (e.g., a position depicted in FIG. 2). When the upper housing 1*a* is in the separated position, a part of a conveying path of a paper sheet P may be exposed, and a workspace for a user may be created between the upper housing 1*a* and the lower housing 1*b*. In the separated position, for example, the user may perform a manual unjamming procedure (e.g., an operation to remove the paper sheet P jammed in the conveying path) in the workspace.

The upper housing 1*a* is urged in the direction from the closed position toward the separated position by a spring or other means. The upper housing 1*a* may open to a predetermined angle with respect to a horizontal plane, and a stopper or other means may prevent the upper housing 1*a* from opening beyond the predetermined angle. The predetermined angle may be defined by the configuration of the upper housing 1*a* and the lower housing 1*b*. For example, the predetermined angle may be about 29 degrees.

A locking mechanism 70 may be disposed in the front of the upper housing 1*a* (e.g., on the near left side of the page of FIG. 2). The locking mechanism 70 may regulate movement of the upper housing 1*a* in the closed position. A lid 1*d*, which may be opened and closed, may be disposed in the front of the lower housing 1*b*. The lid 1*d* may cover the front of the upper housing 1*a*. Opening the lid 1*d* may expose the locking mechanism 70.

As depicted in FIGS. 1 and 3, a holding portion 1*e* may be disposed in an upper portion of the upper housing 1*a*. As depicted by arrow heads trailed by bold dashed lines in FIG. 3, the conveying path, in which the paper sheet P may be conveyed toward the holding portion 1*e* from the paper feed device 1*c*, may be formed in the internal space defined by the upper housing 1*a* and the lower housing 1*b* when the upper housing 1*a* is in the closed position (e.g., the internal space of the inkjet printer 1).

Figure 4A:
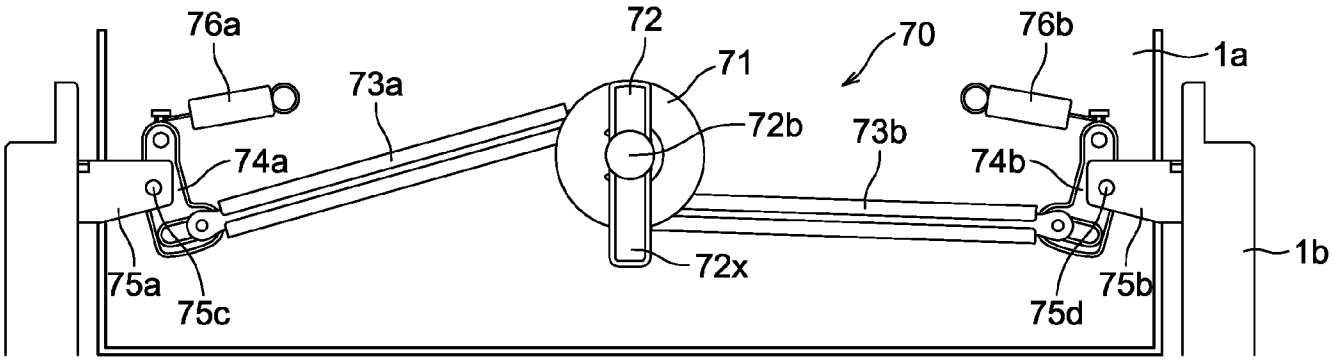
FIG. 4(*a*) is a front view of a locking mechanism of the inkjet printer, which depicts a state in which movement of the upper housing is controlled by the locking mechanism.
Figure 4B:
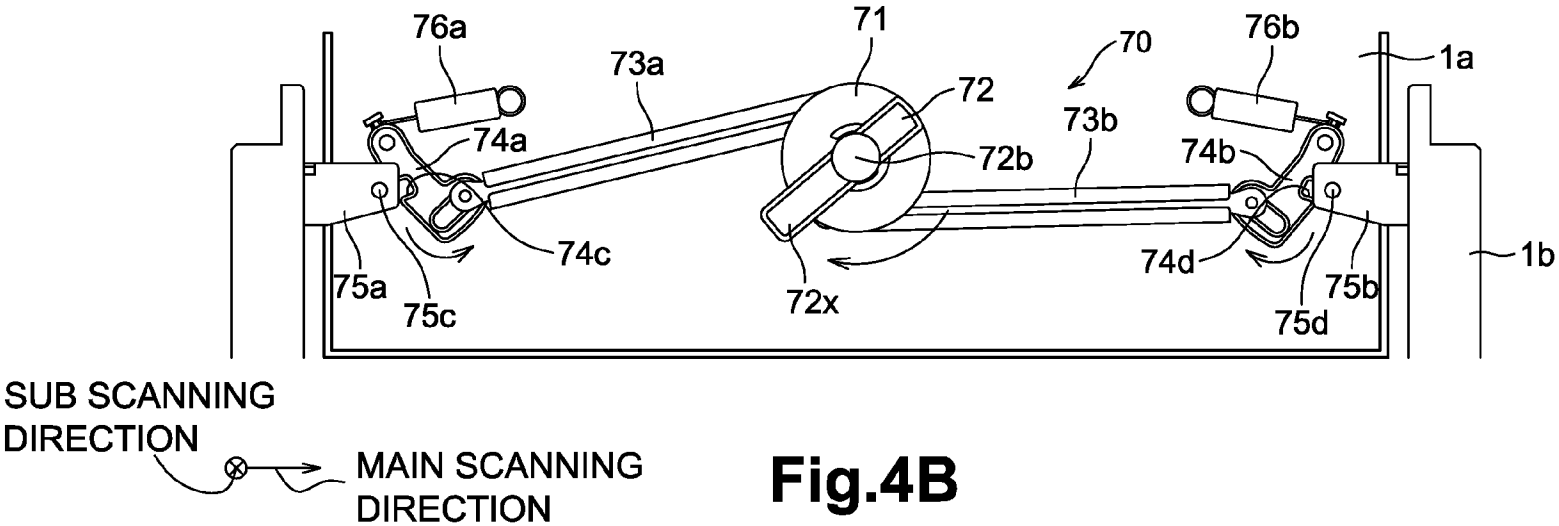

A configuration of the locking mechanism 70 now is described with reference to FIGS. 4A and 4B. The locking mechanism 70 may comprise a cylindrical rotating member 71, two cooperating members 73*a* and 73*b*, two swing members 74*a* and 74*b*, two springs 76*a* and 76*b*, and two fixing members 75*a* and 75*b*. One end of each of the cooperating members 73*a* and 73*b* may be connected to a peripheral surface of the rotating member 71. The swing member 74*a* may comprise a recess 74*c* formed therein, and the swing member 74*b* may comprise a recess 74*d* formed therein. Recesses 74*c* and 74*d* may open on respective sides of the swing members 74*a* and 74*b*, which face away from the rotating member 71. The fixing member 75*a* may comprise a shaft member 75*c*, and the fixing member 75*b* may comprise a shaft member 75*d*. The shaft member 75*c* may insert into the recess 74*c*, and the shaft member 75*d* may insert into the recess 74*d*. The swing axes of the swing members 74*a* and 74*b* may be fixed to the upper housing 1*a*. Ends of the springs 76*a* and 76*b* near the rotating member 71 may be fixed to the upper housing 1*a*. The fixing members 75*a* and 75*b* may be fixed to the lower housing 1*b*.

A rod-shaped knob 72 may be fixed to the front of the rotating member 71. The rod-shaped knob 72 may rotate integrally with the rotating member 71. The springs 76*a* and 76*b* may urge upper ends of the swing members 74*a* and 74*b* toward the rotating member 71. In this configuration, the components of the locking mechanism 70 may stop, such that the rod-shaped knob 72 extends in a substantially vertical direction when no external force is applied, as depicted in FIG. 4(*a*).

As depicted in FIG. 4(*a*), the recesses 74*c* and 74*d* may engage the shaft members 75*c* and 75*d*, respectively. With this engagement, movement of the upper housing 1*a* may be restricted to prevent the upper housing 1*a* from pivoting to the separated position from the closed position. When the user rotates the knob 72 clockwise against the urging force of the springs 76*a* and 76*b*, the recesses 74*c* and 74*d* may be separated from the shaft members 75*c* and 75*d*, as depicted in FIG. 4(*b*). The upper housing 1*a* subsequently may be released, and the upper housing 1*a* may be free to pivot about axis 1*x*. When the upper housing 1*a* is returned to the closed position from the separated position, the recesses 74*c* and 74*d* again may engage the shaft members 75*c* and 75*d*. Therefore, the locking mechanism 70 again may restrict the movement of the upper housing 1*a*.

Components disposed in the internal space of the inkjet printer 1 now are described with reference to FIG. 3 and other drawings.

As depicted in FIG. 3, the following components may be disposed in the internal space of the inkjet printer 1: a control device 100 which may control components of the inkjet printer 1; a conveyance device 50 which may define the conveying path of the paper sheet P; a head device 9 which may comprise two heads 10 for ejecting recording liquid; two cartridges (not depicted), each corresponding to the two heads 10; a support portion 60; a vessel C1; a paper feed device 1*c*; and a power board 85 for the inkjet printer 1.

In accordance with recording instructions issued by an external device (e.g., a PC connected to the inkjet printer 1), the control device 100 may control a preparatory operation related to recording, operations regarding supply, conveyance and output of the paper sheet P, a recording liquid ejecting operation synchronized with the conveyance of the paper sheet P, and other operations associated with recording an image on the paper sheet P.

The control device 100 may comprise, for example, read only memory ("ROM"), random access memory ("RAM," including non volatile RAM), an interface ("I/F") and an input/output port ("I/O"), in addition to a central processing unit ("CPU"), which may be a processor. The ROM may store programs for execution by the CPU, various kinds of fixed data, and other information. Data (e.g., image data) for the execution of the programs may be stored temporarily in the RAM. One or more application specific integrated circuits ("ASICs") may rewrite and rearrange image data (e.g., perform signal processing and image processing) and may perform other processes. The I/F may perform data transmission and reception with external devices. The I/O may receive input detection signals from various sensors and may output information.

The conveyance device 50 may define a conveying path. The conveying path may comprise paths R1, R2, and R3, which may be associated with conveyance of a paper sheet P from the paper feed device 1*c*, and paths T1, T2, and T3, which may be associated with re-conveyance of the paper sheet P. The conveyance device 50 may comprise the following components, which may define the paths R1, R2, and R3; the paths T1, T2, and T3; and a conveying motor (not depicted).

The path R1 may be a U-shaped path in a plane perpendicular to the main scanning direction and may extend from the paper feed device 1*c* to a recording position (e.g., a position facing an ejection surface 10*a*). The path R1 may be defined by a guide 31*a*, a pair of rollers 22, a guide 31*b*, a pair of rollers 23, a guide 31*c*, a guide 31*d*, and a pair of rollers 24. These components may be arranged in the above-described order along the conveying direction.

The path R2 may pass through the recording position of each of the heads 10, and the path R2 may be defined by a guide 32*a*, a pressure roller 33, and a pair of rollers 25. These components may be disposed between the heads 10. The pressure roller 33 and the pair of rollers 25 may be arranged in the above-described order along the conveying direction.

A path R3 may be a U-shaped path in a plane perpendicular to the main scanning direction and disposed further downstream in the conveying direction, than the recording position. The path R3 may extend from a guide 32*b* to the holding portion 1*e*. The path R3 may be defined by guides 32*b*, 33*a*, and 33*b*; a pressure roller 35; and pairs of rollers 26, 27, and 28. The pairs of rollers 26, 27, and 28 may be arranged in the above-described order along conveying direction. The roller 28 may output the paper sheet P from the housing 1*a*, via the opening 150, in an output direction. For example, the output direction may be a substantially horizontal direction (e.g., substantially perpendicular to the vertical direction depicted in FIG. 3) or the output direction may be inclined with respect to the substantially horizontal direction. Multiple pressure rollers 35 may be disposed along the path R3. The path R3 may be disposed downstream from the recording position in the conveyance direction and may curve in the direction opposite to the path R1 while extending upward in the substantially vertical direction depicted in FIG. 3. Accordingly, based on the orientation of the inkjet printer 1 depicted in FIG. 3, the path R1 may curve to the right (e.g., the path R1 is a U-shaped path which opens to the right), whereas the path R3 may curve to the left (e.g., the path R3 is a U-shaped path which opens to the left). Thus, the paths R1, R2, and R3 may combine to form a conveyance path having an inverse S shape.

The path T1 may extend downward in the substantially vertical direction depicted in FIG. 3. The path T1 may be defined by a guide 95*a* and a pair of rollers 96. The path T2 may extend in a direction opposite to the sub-scanning direction depicted in FIG. 3, and the path T2 may be defined by a guide 95*b* and a pair of rollers 97. The path T3 may extend obliquely upward in the vertical direction depicted in FIG. 3 and may reach the middle of the path R1. The path T3 may be defined by a guide 95*c*.

The pairs of rollers 22, 23, 24, 25, 26, 27, and 28 and the pairs of rollers 96 and 97 each may comprise a driving roller connected to the conveying motor and a driven roller, which may be driven by the respective driving roller.

The head device 9 may comprise two heads 10, a main carriage 3*a*, and a sub-carriage 3*b*. The main carriage 3*a* and the sub-carriage 3*b* may support the heads 10. One of the heads 10 may be a pre-coating head that ejects pretreatment liquid, and the other head may be an inkjet head that ejects black ink. The pre-coating head and the inkjet head may be arranged in the above-described order along the conveying direction.

The heads 10 may have similar structures Each of the heads 10 may be a substantially rectangular, parallelepiped-shaped head extending in the main scanning direction depicted in FIG. 3. The heads 10 may be separated from each other in the sub-scanning direction (e.g., a direction perpendicular to the main scanning direction and to the substantially vertical direction), and the heads 10 may be fixed to the sub-carriage 3*b*. The sub-carriage 3*b* may be supported by the upper housing 1*a* via the main carriage 3*a*. The main carriage 3*a* may be fixed to the upper housing 1*a*. The main carriage 3*a* may support the sub-carriage 3*b*, such that sub-carriage 3*b* may engage in reciprocating motion in the substantially vertical direction.

An ejection surface 10*a* may be disposed on a lower surface of the head 10. Many ejection ports may be formed on the ejection surface 10*a*. Recording liquid paths may be formed inside the head 10. The pretreatment liquid and black ink (collectively referred to as "recording liquid") supplied from the cartridges may flow in the recording liquid paths and may reach the ejection ports. Fore example, the pretreatment liquid may function to prevent ink bleeding and strike through and may function to improve color enhancement and drying characteristics of the ink.

The support portion 60 may be disposed to face the ejection surfaces 10*a* of the heads 10 in the vertical direction. The support portion 60 may comprise: two rotary members 63, each facing one of the heads 10; a platen 61 and a facing member 62 fixed to a peripheral surface of each of the rotary members 63; and a frame 11 that may support rotatably the rotary members 63.

The length of the platen 61 and the facing member 62 may be slightly greater than the length of the ejection surface 10*a* in the main scanning direction and the sub-scanning direction. The platen 61 and the facing member 62 may be disposed to face each other in the substantially vertical direction. A surface of the platen 61 may be a support surface 61*a* that may face the ejection surface 10*a* and support the paper sheet P. Many ribs may be formed in the support surface 61*a* along the sub-scanning direction. The facing member 62 may comprise water impermeable materials or nearly water impermeable materials. A surface of the facing member 62 may be a facing surface 62*a* that may face the ejection surface 10*a*.

The rotation of the rotary member 63 about an axis of rotation thereof along the main scanning direction may switch between a first configuration (e.g., a state depicted in FIG. 3) and a second configuration (not depicted). In the first configuration, the support surface 61*a* may face the ejection surfaces 10*a*, whereas the facing surface 62*a* may not face the ejection surfaces 10*a*. In the second configuration, the support surface 61*a* may not face the ejection surfaces 10*a*, whereas the facing surface 62*a* faces the ejection surfaces 10*a*. The control device 100 may control the rotary member 63 to be in the first configuration when recording liquid is ejected from the ejection ports onto the paper sheet P to form an image. The control device 100 may control the rotary member 63 to be in the second configuration when capping is performed. Capping may be an operation to cause an end of a cap member (not depicted), which may project downward from the peripheral portions of a lower end of each head 10, to abut the facing surface 62*a*, such that the space facing the ejection surface 10*a* may be separated from the external space.

The paper feed device 1*c* may be disposed below the head device 9, the support portion 60, and the vessel C1. The paper feed device 1*c* may comprise a paper sheet feed tray 20 and a paper sheet feed roller 21. The paper sheet feed tray 20 may be attachable to and detachable from the lower housing 1*b*, along the sub-scanning direction. The paper sheet feed tray 20 may be an upwardly-open, box box-shaped tray that may hold paper sheets P of several sizes. The control of the control device 100 may control a motor to rotate paper sheet feed roller 21, and paper sheet feed roller 21 may send out the uppermost paper sheet P from the paper sheet feed tray 20.

The paper sheet P sent out from the paper sheet feed tray 20 may be conveyed along the paths R1 and R2 under the control of the control device 100. When the paper sheet P supported by the support surface 61*a* passes a position directly below the heads 10 (e.g., a recording position), each head 10 may be driven by the control device 100; recording liquid may be ejected from ejection ports of the ejection surface 10*a* onto the paper sheet P, such that an image may form on the paper sheet P. In the single-sided recording process, the paper sheet P then may be conveyed along the path R3 and may be output to the holding portion 1*e*. In the double-sided recording process, the paper sheet P may not be output to the holding portion 1*e*, but may be conveyed along the re-conveying paths T1, T2, and T3. The paper sheet P then may be returned to the path R1 and again may be conveyed along the path R2 and R3. After an image is formed on the reverse side, printer 1 may output the paper sheet P to the holding portion 1*e*.

The vessel C1 may be a rectangular, parallel piped-shaped vessel comprising an opening formed by the vessel C1's walls, which may open upward when the vessel is positioned below the heads 10 and the support portion 60. The opening of the vessel C1 may face the ejection surfaces 10*a* of the two heads 10 and the surfaces 61*a* and 62*b* of the support portion 60 in the substantially vertical direction (e.g., a direction substantially parallel to a direction of gravity). Accordingly, the heads 10 and the vessel C1 overlap each other seen in the vertical direction. The vessel C1 may extend beyond the surfaces 10*a*, 61*a*, and 62*a* in the horizontal direction (e.g., the main scanning direction depicted in FIGS. 3 and 5). Consequently, a significant portion of the support portion 60 may be disposed inside the vessel C1. In this configuration, even when the recording liquid, which may be ejected from the ejection ports of the heads 10, spatters during the recording, or even when the recording liquid leaks out of the cap member during a purge (e.g., forced ejection of the recording liquid through the ejection ports) while performing the capping, the recording liquid may be received in the vessel C1 (e.g., via gravity), such that adhesion of the recording liquid to components other than the vessel C1 in the inkjet printer 1 may be reduced.

At the bottom of the vessel C1, an absorber 66 may be disposed on a surface (e.g., an upper surface of the bottom of the vessel C1) that faces the ejection surfaces 10*a*. The absorber 66 may absorb and retain recording liquid. The absorber 66 may comprise sponge or other absorbant materials, and the absorber 66 may be disposed across the entire area of the upper surface of the bottom of the vessel C1. Recording liquid received in the vessel C1 may be absorbed and retained by the absorber 66.

The power board 85 may be disposed below the paper sheet feed tray 20. A power circuit may be formed in the power board 85. The power circuit may generate power for the components that are electrically driven (e.g., the control device 100, various sensors, and various motors) in the inkjet printer 1.

A vessel C2 may be disposed below the power board 85. The vessel C2, which may be similar to the vessel C1, may be a rectangular, parallelpiped-shaped vessel comprising an opening formed by the vessel C2's walls, which may open upward when the vessel is positioned below the paper sheet feed tray 20. The vessel C2 may be formed by a lower portion of the lower housing 1*b*. The opening of the vessel C2 may face the power board 85 in the vertical direction and may surround the power board 85.

At the bottom of the vessel C2, an absorber 86 may be disposed on a surface (e.g., an upper surface of the bottom of the vessel C2) that faces the power board 85. The absorber 86 may absorb and retain recording liquid. The absorber 86 may comprise sponge or other absorbent materials, and the absorber 86 may be disposed across the entire area of the upper surface of the bottom of the vessel C2. Recording liquid received by the vessel C2 may be absorbed and retained by the absorber 86.

A plurality of projections 1*b*2 that project upward from the bottom (e.g., the bottom of the vessel C2) 1*b*1 of the lower housing 1*b* may support the power board 85 from below. Ends of the projections 1*b*2 may extend above the absorber 86 in the substantially vertical direction. Therefore, the power board 85 may be separated from the bottom 1*b*1 of the lower housing 1*b* and from the absorber 86.

Figure 5:
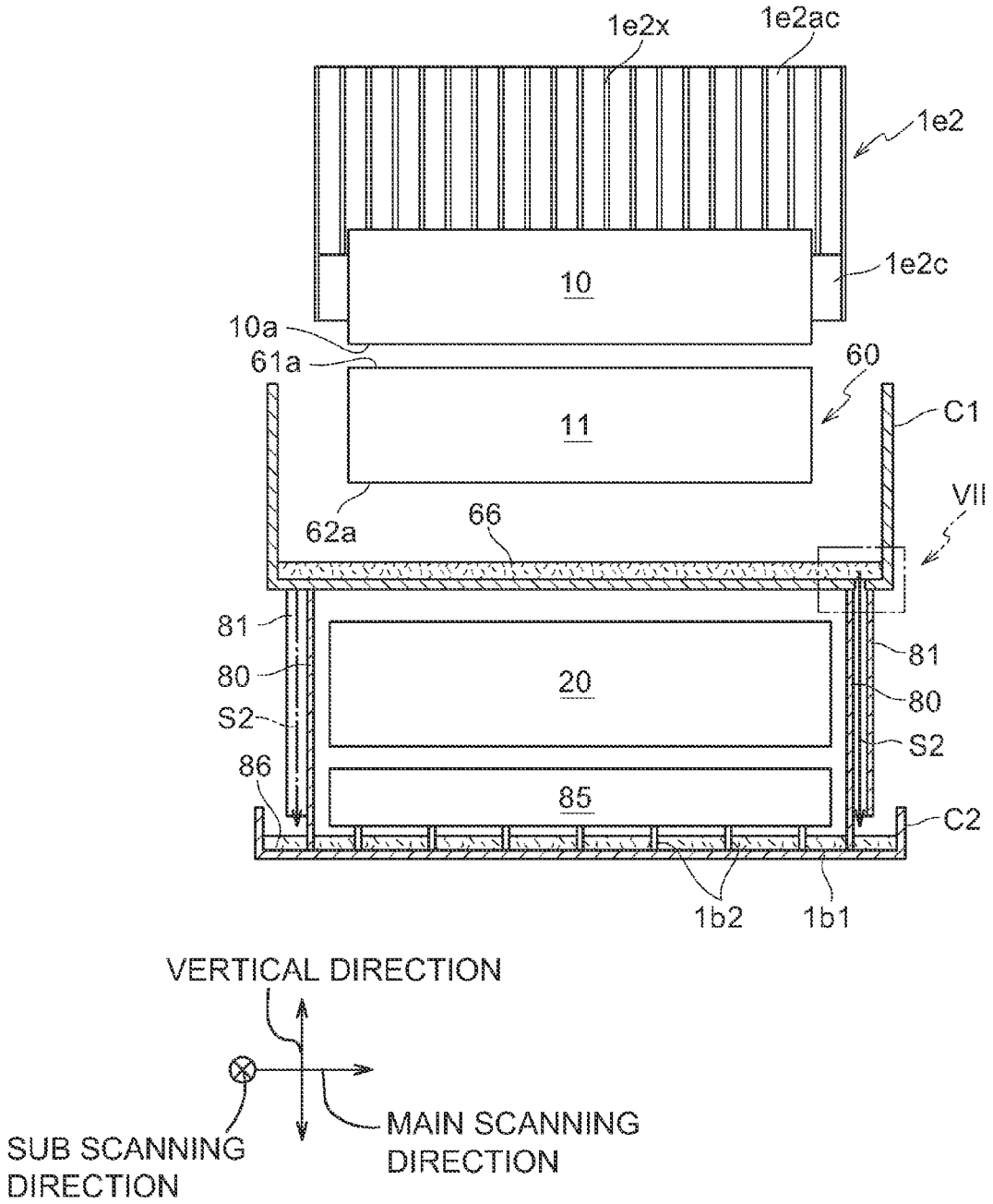
FIG. 5 is a partial cross-sectional view along line V-V depicted in FIG. 3.

The vessel C1 and the vessel C2 may connect to each other via a frame 80, as depicted in FIG. 5. The frame 80 may be fixed to the lower housing 1*b*. The bottom of the vessel C1 may be fixed to an upper end of the frame 80 in the substantially vertical direction, and a lower end of frame 80 in the substantially vertical direction may be fixed to the bottom 1*b*1 of the vessel C2. The paper sheet feed tray 20 and the power board 85 may be disposed inside the frame 80.

Figure 6:
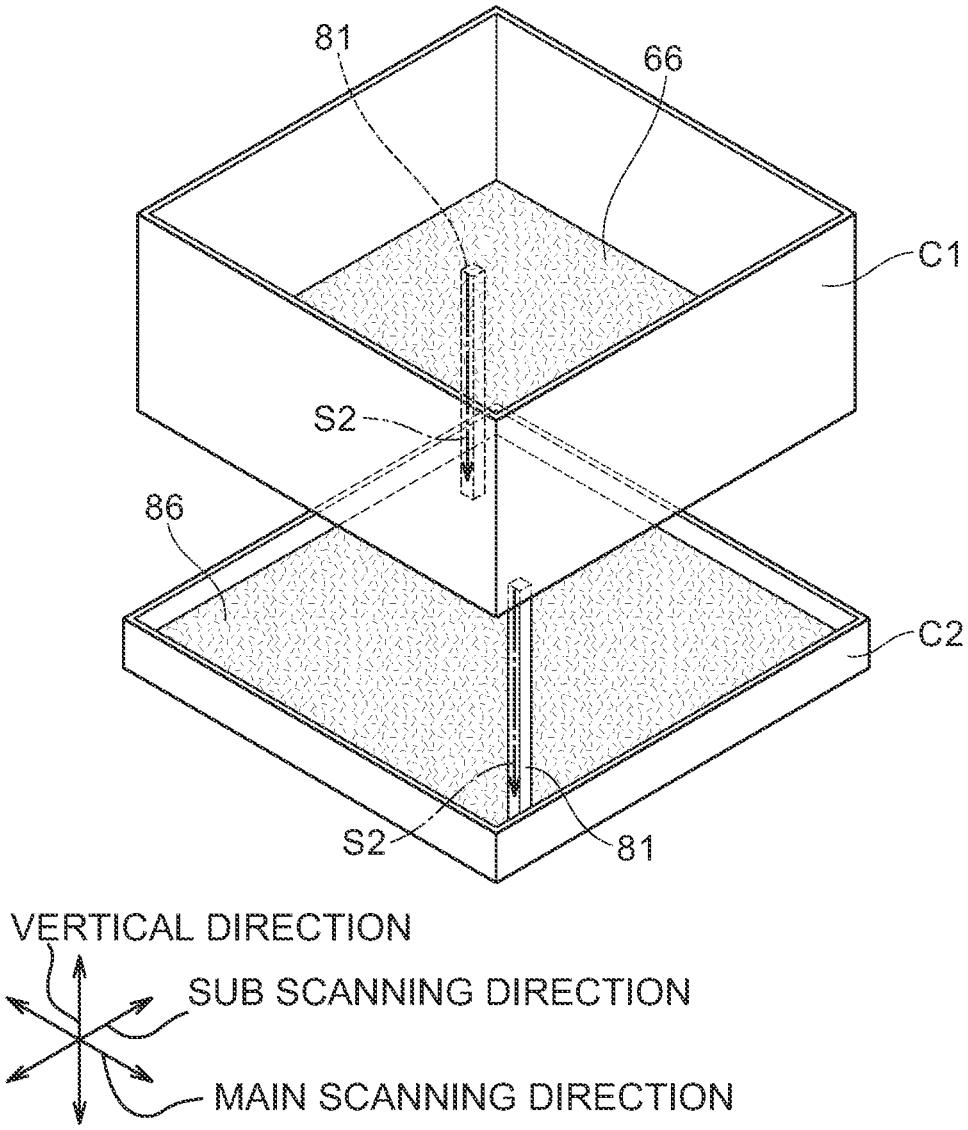
FIG. 6 is a schematic, perspective view of two vessels and a further path disposed therebetween.
Figure 7:
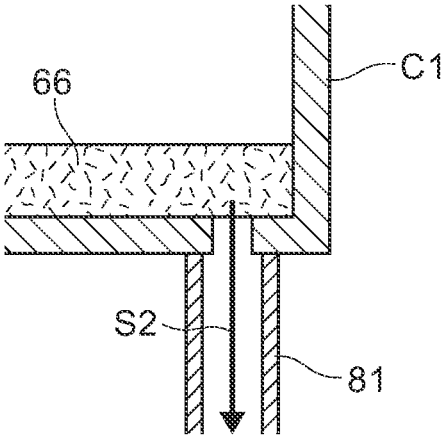
FIG. 7 is an enlarged view of an area VII depicted in FIG. 5.

A pair of pipes 81 may be fixed to a side portion of the frame 80, as depicted in FIGS. 5 and 6. The pipes 81 may sandwich the paper sheet feed tray 20 and the power board 85 therebetween. Each of the pipes 81 may extend from the bottom of the vessel C1 downward, passing by the side portions of the paper sheet feed tray 20 and the power board 85, to reach a position above the vessel C2 (e.g., a position immediately above the absorber 86 in the substantially vertical direction). A through hole may be formed at the bottom of the vessel C1, as depicted in FIG. 7. The pipe 81 and the inside of the vessel C1 may communicate with each other via the through hole.

A configuration of the holding portion 1*e* now is described with reference to FIGS. 1, 3, and 8.

The holding portion 1*e* comprises a support member 1*e*1 and a guide member 1*e*2, as depicted in FIGS. 1 and 3.

The support member 1*e*1 may be formed by an upper wall of the upper housing 1*a* and may comprise a surface 1*e*1*c* that supports the output paper sheet P. The surface 1*e*1*c* of the support member 1*e*1 may incline downward, with respect to the horizontal direction, toward an opening 1*e*3 in the conveying direction. As depicted in FIG. 1, a plurality of recesses 1*e*1*x* extending in the conveying direction may be formed on a substantial portion of the surface 1*e*1*c*.

Figure 8:
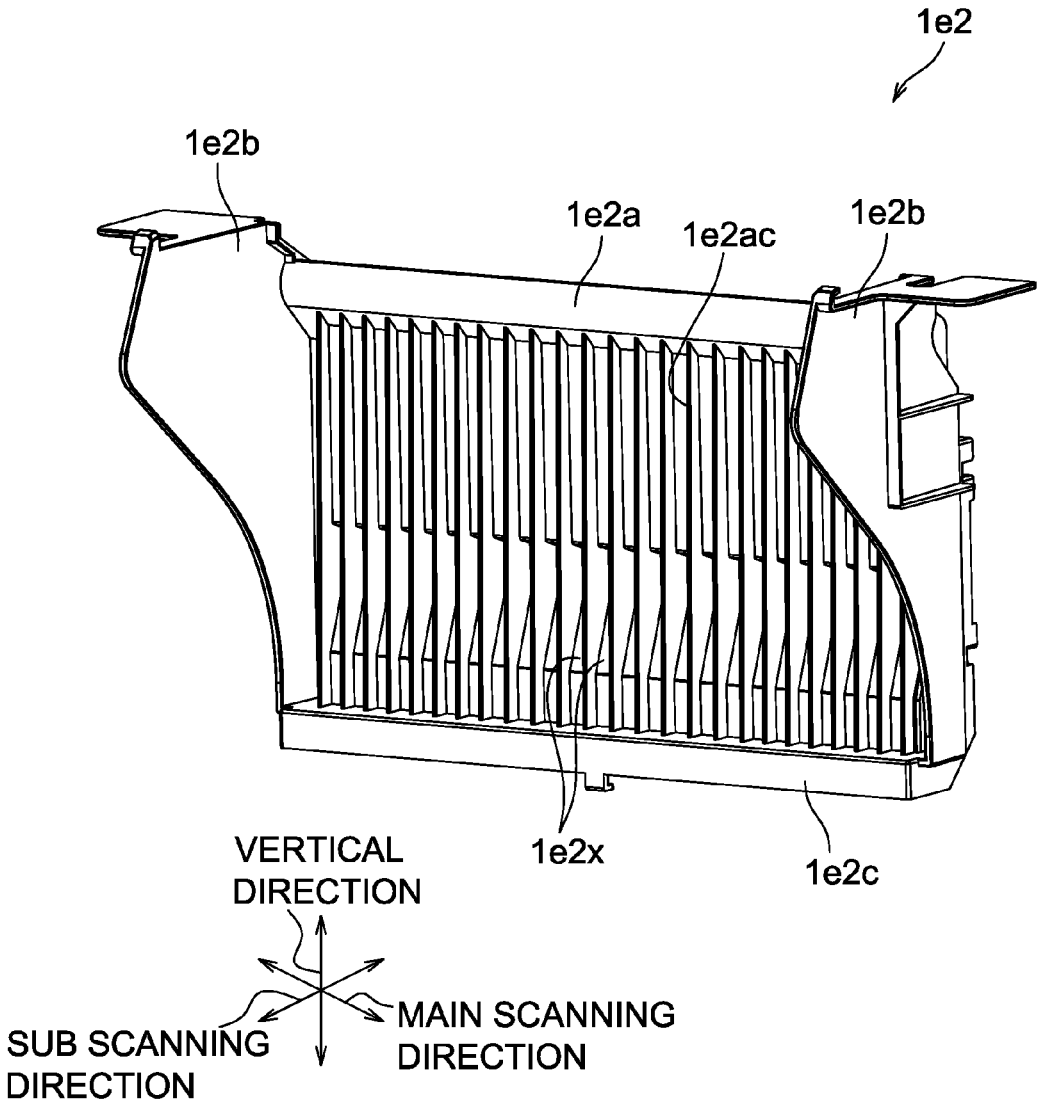
FIG. 8 is a perspective view of a guide member of the inkjet printer.

The guide member 1*e*2 may comprise a main portion 1*e*2*a* and a pair of side portions 1*e*2*b* extending uprightly from side edges of the main portion 1*e*2*a*, as depicted in FIGS. 1, 3, and 8. The side edges of the main portion 1*e*2*a* may be boundaries along the main scanning direction on a surface 1*e*2*ac* (e.g., a surface facing the opening 1*e*3) of the main portion 1*e*2*a*. The main portion 1*e*2*a* may extend in the substantially vertical direction and in the main scanning direction, and the side portions 1*e*2*b* may extend in the substantially vertical direction and in the sub-scanning direction. The main portion 1*e*2*a* may be disposed upstream of the support member 1*e*1 in the conveying direction, and a gap (e.g., an opening) 1*e*3 may be formed between the main portion 1*e*2*a* and the support member 1*e*1. A plurality of recesses 1*e*2*x*, which may extend in the substantially vertical direction, may be formed on the substantial portion of the surface 1*e*2*ac* of the main portion 1*e*2*a*. The support member 1*e*1 and the guide member 1*e*2 may constitute wall surfaces of the holding portion 1*e*. In particular, the surface 1*e*1*c* of the support member 1*e*1 and the surface 1*e*2*ac* of the main portion 1*e*2*a* of the guide member 1*e*2 may constitute the wall surfaces of the holding portion 1*e*. Accordingly, the surface 1*e*1*c* of the support member 1*e*1 may constitute a part of the wall surface of the holding portion 1*e*, and the surface 1*e*2*ac* of the main portion 1*e*2*a* of the guide member 1*e*2 may constitute a part of the wall surface of the holding portion 1*e*.

The main portion 1*e*2*a* may extend below the opening 1*e*3, as depicted in FIG. 3. A lower end of the surface 1*e*2*ac* of the main portion 1*e*2*a* may be disposed inside the vessel C1 when the lower end of the surface 1*e*2*ac* and the vessel C1 are projected onto a plane perpendicular to the substantially vertical direction. In particular, a projection 1*e*2*c* depicted in FIGS. 5 and 8 and protruding to the left in FIG. 3 may be disposed at the lower end of the surface 1*e*2*ac* of the main portion 1*e*2*a*. The projection 1*e*2*c* may be disposed inside the vessel C1 when the projection 1*e*2*c* and the vessel C1 are projected onto the plane perpendicular to the substantially vertical direction. As depicted in FIG. 5, the length of the guide member 1*e*2 in the main scanning direction may be less than the length of the vessel C1 in the main scanning direction. Consequently, the entire guide member 1*e*2 may be disposed inside the vessel C1, and the entire guide member 1*e*2 and the vessel C1 are projected onto the plane perpendicular to the substantially vertical direction. The straight line L depicted in FIG. 3 may be drawn along the lower end of the surface 1*e*2*ac* of the main portion 1*e*2*a* in the substantially vertical direction. The holding portion 1*e* and the vessel C1 may overlap each other, when the holding portion 1*e* and the vessel C1 are projected onto the plane perpendicular to the substantially vertical direction.

The portion of printer 1 disposed further below the opening 1*e*3 in the surface 1*e*2*ac* of the main portion 1*e*2*a* may define a first path S1, in which the liquid entered through the opening 1*e*3 may be guided to the vessel C1. A gap may be formed between the guides 32*b* and the 33*a*. The gap may be a part of the first path S1. Accordingly, a gap, which may be a part of the first path S1, may be formed near the lower end of the main portion 1*e*2*a* of the guide member 1*e*2 in the guide that defines the conveying path. Consequently, when the user spills liquid, such as a beverage, onto the holding portion 1*e*, the liquid may enter the printer 1 through the opening 1*e*3, may flow along the first path S1, and may be received in the vessel C1. As depicted in FIG. 5, when the amount of the liquid received in the vessel C1 exceeds the capacity of the absorber 66 in the vessel C1, overflowing liquid may pass through a second path S2 in the pipe 81 and may be received in the vessel C2. The holding portion 1*e* and the paper sheet feed tray 20 may overlap each other, when the holding portion 1*e* and the paper sheet feed tray 20 are projected onto the plane perpendicular to the substantially vertical direction.

When the amount of the liquid received in the vessel C2 exceeds the capacity of the absorber 86 in the vessel C2, the control device 100 may provide an error notification via an output device, such as one or more of a display and a speaker comprised in the inkjet printer 1, and the control device 100 may control the operations of the components of the inkjet printer 1 to stop. Although not depicted, a conduction sensor formed by a pair of electrodes may be disposed in a cavity formed in the absorber 86. When the amount of liquid received in the vessel C2 exceeds the capacity of the absorber 86 in the vessel C2, the liquid may enter the cavity, and the conduction sensor may detect conduction between the electrodes. In accordance with signals from the conduction sensor, the control device 100 may determine whether the vessel C2 has received an amount of liquid exceeding the capacity of the absorber 86.

The opposite side of the main portion 1*e*2*a* (e.g., a side opposite to the surface that faces the opening 1*e*3) may define the path R3, as depicted in FIG. 3. In particular, the opposite side of the main portion 1*e*2*a* may form a part of the guides 33*a* and 33*b*.

The upper housing 1*a* may support the support member 1*e*1. The lower housing 1*b* may support the guide member 1*e*2. The lower housing 1*b* may support components of the conveyance device 50, the support portion 60, the paper sheet feed tray 20, the vessels C1 and C2, and the power board 85. When the upper housing 1*a* is pivoted toward the separated position from the closed position, the components supported by the upper housing 1*a* may move together with the upper housing 1*a*, whereas the components supported by the lower housing 1*b* may not move and may stay in fixed positions. At the time of this pivoting, the support member 1*e*1 may move with respect to the guide member 1*e*2, but the support member 1*e*1 may not touch the guide member 1*e*2 because of the existence of the opening 1*e*3.

As described above, the paper sheet feed tray 20 may be disposed below the vessel C1 in the substantially vertical alignment, and the holding portion 1*e* may be disposed above the vessel C1 in the substantially vertical alignment, such that an area of the printer 1 in plan view may be reduced. Liquid, which enters through the opening 1*e*3 of the holding portion 1*e*, may flow along the first path S1 to the vessel C1 and may be received therein. In this configuration, adhesion of liquid, which enters through a opening 1*e*3 in a holding portion 1*e*, to the paper sheet feed tray 20 or to the paper sheet P in the paper sheet feed tray 20 may be reduced, and the area of the entire printer 1 may be reduced in plan view.

When the upper housing 1*a* which supports the heads 10 is pivoted with respect to the lower housing 1*b* that supports the conveyance device 50, the heads 10 may be separated from the conveyance device 50, and, thereby, the conveying path may be exposed. This allows the user to perform a manual unjamming procedure (e.g., an operation to remove the paper sheet P jammed in the conveying path) in the space formed between the upper housing 1*a* and the lower housing 1*b*.

In such a configuration, however, a gap for the prevention of interference is necessary between the upper housing 1*a* and the lower housing 1*b*. Accordingly, when the holding portion 1*e* is formed by a part of the upper housing 1*a* (e.g., the support member 1*e*1) and a part of the lower housing 1*b* (e.g., a guide member 1*e*2), as described above, a gap may be formed unintentionally between the support member 1*e*1 and the guide member 1*e*2. In this configuration, when liquid enters the inkjet printer 1 through the gap (e.g., the opening 1*e*3), adhesion of liquid to the paper sheet feed tray 20 or to the paper sheet P in the paper sheet feed tray 20 may occur. Nevertheless, liquid that enters the inkjet printer 1 through the opening 1*e*3 may flow along the first path S1 to the vessel C1 and may be received therein. Therefore, according to the embodiments described above, the user may perform an unjamming procedure and, at the same time adhesion of liquid that enters through the opening 1*e*3 of the holding portion 1*e* to the paper sheet feed tray 20 or to the paper sheet P in the paper sheet feed tray 20 may be reduced.

The surface 1*e*1*c* of the support member 1*e*1 may incline downward toward the opening 1*e*3 along the conveying direction depicted in FIGS. 1 and 3. In the configuration described above, the inclination may guide liquid spilt on the surface 1*e*1*c* of the support member 1*e*1 to the opening 1*e*3. Therefore, this configuration may reduce an amount of liquid that may flow out of the opening 1*e*3.

A plurality of recesses 1*e*1*x* may extend in the conveying direction and may be formed on the surface 1*e*1*c* of the support member 1*e*1. In the configuration described above, liquid spilt onto the surface 1*e*1*c* of the support member 1*e*1 may be guided to the opening 1*e*3 through the recesses 1*e*1*x*. Therefore, this configuration may reduce an amount of liquid that flows out of the opening 1*e*3.

The surface 1*e*2*ac* of the main portion 1*e*2*a* of the guide member 1*e*2 may extend in the substantially vertical direction. In the configuration described above, liquid spilt onto or adhering to the surface 1*e*2*ac* of the main portion 1*e*2*a* may be guided to the opening 1*e*3 along the substantially vertical direction. Therefore, this configuration may reduce an amount of liquid that flows out of the opening 1*e*3.

A plurality of recesses 1*e*2*x* may extend in the substantially vertical direction and may be formed in the surface 1*e*2*ac* of the main portion 1*e*2*a* of the guide member 1*e*2. In the configuration described above, liquid spilt onto or adhering to the surface 1*e*2*ac* of the main portion 1*e*2*a* may be guided to the opening 1*e*3 through the recesses 1*e*2*x*. Therefore, this configuration may reduce an amount of liquid that flows out of the opening 1*e*3 more reliably.

The surface 1*e*2*ac* of the main portion 1*e*2*a* of the guide member 1*e*2 may extend further below the opening 1*e*3 in the substantially vertical direction, and the portion extending below the opening 1*e*3 of the surface 1*e*2*ac* of the main portion 1e2a may define the first path S1. The lower end of the surface 1e2ac of the main portion 1e2a may be disposed inside the vessel C1 when the lower end of the surface 1e2ac and the vessel C1 are projected onto a plane perpendicular to the substantially vertical direction. In the configuration described above, the liquid that enters through the opening 1e3 may be guided downward along the surface 1e2ac of the main portion 1e2a, and the liquid reliably may be received in the vessel C1 from the lower end of the surface 1e2ac of the main portion 1e2a.

The opposite side of the main portion 1e2a of the guide member 1e2 may define the conveying path along which the conveyance device 50 may convey the paper sheet P. The guide member 1e2, which the lower housing 1b may support, may not be moved and may stay at the fixed position thereof when the upper housing 1a is pivoted. When the guide member 1e2 defines the conveying path, certain problems may arise. For example, when the guide member 1e2, which the upper housing 1a may support, is pivoted together with the upper housing 1a, precision of the conveying path may be reduced. In the configuration described above, such a problem may be mitigated.

The guide member 1e2 may comprise the side portions 1e2b extending uprightly from the side edges of the main portion 1e2a in the substantially vertical direction. In the configuration described above, even when liquid spilt onto or adhering to the surface 1e2ac of the main portion 1e2a flows into the side of the surface, the liquid may be held back by the side portions 1e2b and may be guided to the opening 1e3. This may reduce the likelihood of an outflow of liquid toward portions other than the opening 1e3.

The inkjet printer 1 may comprise the vessel C2 disposed below the paper sheet feed tray 20 in the substantially vertical direction and disposed below the second path S2, in which liquid may pass from the vessel C1 to the vessel C2 via the side of the paper sheet feed tray 20. When the vessel C1 is filled with liquid, liquid may overflow the vessel C1 and may adhere to the paper sheet feed tray 20 or the paper sheet P in the paper sheet feed tray 20 disposed below the vessel C1. In the configuration described above, even when the vessel C1 is filled with liquid, liquid may pass in the second path S2 from the vessel C1 to the vessel C2, via the side of the paper sheet feed tray 20 (e.g., through the pipes 81). The vessel C2 subsequently may receive the liquid. Therefore, the problem described above may be reduced or eliminated.

The inkjet printer 1 may comprise the power board 85 disposed at a position separated from the vessel C2 that may be below the paper sheet feed tray 20 and above the vessel C2. The second path S2 may extend to reach the vessel C2 from the vessel C1, via the side of the paper sheet feed tray 20 and the side of the power board 85. Adhesion of liquid to the power board 85 may cause combustion or malfunction. Therefore, the power board 85 may be disposed at a position where there may be a lower possibility of adhesion of liquid (e.g., an upper portion of the inkjet printer 1, such as a position above the heads 10 in the substantially vertical direction). Nevertheless, the power board 85 may be disposed at a lower portion of the inkjet printer 1 because of, for example, restrictions of the layout. Even in such a case, adhesion of the liquid to the power board 85 may be reduced by the second path S2.

Although embodiments of the present invention have been described above, the present invention is not limited to these embodiments. Various design changes may be made without departing from the scope of the invention.

Configurations (e.g., shape, dimension and the number) of vessels C1 and C2 may be changed. For example, the vessel C1 may be disposed at each head. The vessel C1 may function as a cap member used in the capping process. In this configuration, the vessel C1 may receive the recording liquid ejected from the ejection ports during the purge process. The absorbers 66 and 86 may be disposed across the entire area of the bottom portions of the vessels C1 and C2, respectively. Alternatively, the absorbers 66 and 86 may be disposed across only a part of the area of the bottom portions of the vessels C1 and C2. Fore example, the part of the area may be an area which faces the ejection surface 10a in the vessel C1 and an area which faces the second path S2 in the second receiving device. Alternatively, the absorbers 66 and 86 may be excluded from the vessels C1 and C2. The vessels C1 and C2 may be in fluid communication with a waste liquid reservoir, and liquid received by each of the vessels C1 and C2 may be discharged into the waste liquid reservoir. Alternatively, the vessel C2 may be excluded.

Configurations (e.g., shape, dimension and the number) of the first path S1 and the second path S2 may be changed. The first path 51 may be formed of a pipe similar to the pipe 81 of the second path S2, according to embodiments described above. Liquid that enters through the opening 1e3 of the holding portion may flow to the vessel C1 without touching with another object. Alternatively, the second path S2 may be excluded.

The surface 1e1c, which may support a recording sheet P in the support member 1e1, may extend in various directions. For example, the surface 1e1c, which may support a recording sheet P in the support member 1e1, may extend substantially horizontally. The surface 1e2ac, which may face the opening in a guide member 1e2, also may extend in various directions. For example, the surface 1e2ac, which may face the opening 1e3 in a guide member 1e2, may extend in a direction inclined with respect to the substantially vertical direction (e.g., in the substantially horizontal direction). Alternatively, the side portion 1e2b of the guide member 1e2 may be excluded. The guide member 1e2 may not define the conveying path.

A lower end of the surface 1e2ac, which may face the opening 1e3 in the guide member 1e2, may not be disposed inside the vessel C1 when the surface 1e2ac and the vessel C1 are projected onto a plane perpendicular to the substantially vertical direction. The surface 1e2ac, which may face the opening 1e3 in the guide member 1e2, may not extend further below the opening 1e3. In such configurations, for example, another member that may guide the liquid toward the first receiving device from the surface 1e2ac may be disposed in the inkjet printer 1.

Recesses of the guide member 1e2 may be formed only at portions above the opening 1e3 in the substantially vertical alignment. Alternatively, the recesses of the members 1e1 and 1e2 may be excluded. The holding portion 1e may not be formed by two members, e.g., members 1e1 and 1e2, and may be formed by a single member having an opening formed therein.

An electronic component may not be limited to the power board, and, for example, may be one or more of a control substrate of a conveyance device 50, a control substrate of a head 10, and an integrated circuit ("IC") for apparatus authentication. The electronic component may not be disposed below the paper sheet feed tray 20.

One or more of the paths related to re-conveyance (e.g., paths T1, T2, or T3) may be excluded, and the pressure rollers 33 and 35 may be excluded. The recording medium may be conveyed in a belt conveyance system, rather than the roller conveyance system described above. The configuration of the conveying path may be changed. For example, the paths R1, R2, and R3 associated with conveyance of the recording medium from the paper feed device 1*c* may form an inverted S shape when combined; however, paths related to the conveyance of the recording medium may be other shapes, such as U-shape when combined together.

In yet other embodiments, the upper housing 1*a* may not pivot with respect to the lower housing 1*b*, and the upper housing 1*a* may move substantially horizontally or substantially vertically with respect to the lower housing 1*b*. The housing of the liquid ejection apparatus may not be formed by two members (e.g., the upper and lower housings 1*a* and 1*b*), and the housing may comprise instead a single housing.

The head 10 may eject recording liquid other than pretreatment liquid and ink. The direction in which the ejection surface extends may not be limited to the substantially horizontal direction, and the direction, in which the ejection surface extends, may be the substantially vertical direction. The liquid ejection apparatus may comprise one or more heads 10.

The recording medium may not be limited to the paper sheet P, and the recording medium may be another medium adapted to recording. The present invention may not be limited to a printer, and the invention may be applied to other apparatus, such as facsimile machines and copiers.

While the invention has been described in connection with various exemplary structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative with the true scope of the invention being defined by the following claims.

What is claimed is:

1. A liquid ejection apparatus comprising:

a head comprising a plurality of ejection ports configured to eject a recording liquid onto a recording medium;

a first receiving device disposed below the head along a substantially vertical direction and configured to receive at least a portion of the recording liquid ejected from the ejection ports;

a holding portion disposed above the first receiving device along the substantially vertical direction and configured to hold the recording medium after the head has ejected recording liquid from the ejection ports onto the recording medium, wherein the holding portion comprises a wall surface comprising an opening therein;

a roller disposed above the holding portion along the substantially vertical direction and configured to convey the recording medium to the holding portion; and a first path configured to guide liquid on the wall surface of the holding portion from the opening in the wall surface of the holding portion to the first receiving device, wherein the substantially vertical direction is substantially parallel to a direction of gravity, wherein the wall surface comprises:

a first member configured to support a surface of the recording medium; and a second member disposed such that the opening is formed between the first member and the second member, wherein the liquid ejection apparatus further comprises a conveyance device configured to convey the recording medium through the liquid ejection apparatus, wherein the second member is disposed upstream of the first member in an output direction, wherein the output direction is a direction in which the conveyance device is configured to output the recording medium, wherein the liquid ejection apparatus further comprises:

a first housing configured to support the head and the first member; and a second housing configured to support the first receiving device, the conveyance device, and the second member, wherein the first housing is configured to pivot with respect to the second housing about an axis of rotation such that, as the first housing is pivoted from a closed position to a separated position, the first member becomes closer to the second member in a horizontal direction than it was in the closed position, wherein the horizontal direction is perpendicular to the vertical direction, wherein a surface of the first member is inclined with respect to a plane perpendicular to the substantially vertical direction toward the opening and along the output direction, wherein the surface of the first member is configured to support a surface of the recording medium, wherein the holding portion is aligned above the head along the substantially vertical direction, wherein the liquid ejection apparatus further comprises a feed tray configured to hold the recording medium and disposed below the first receiving device along the substantially vertical direction, and wherein the conveying device comprises a conveying path disposed below the opening along the substantially vertical direction.

2. The liquid ejection apparatus according to claim 1, wherein a plurality of recesses extending along the output direction are formed on the surface of the first member.

3. The liquid ejection apparatus according to claim 1, wherein a surface of the second member faces the opening formed between the first member and the second member, wherein the surface of the second member extends along the substantially vertical direction.

4. The liquid ejection apparatus according to claim 3, wherein a plurality of recesses extending along the substantially vertical direction are formed on at least a portion of the surface of the second member that faces the opening, and wherein the portion of the surface of the second member is above the opening along the substantially vertical direction.

5. The liquid ejection apparatus according to claim 3, wherein the surface of the second member that faces the opening extends below the opening along the substantially vertical direction, wherein a portion of the surface of the second member that faces the opening, extends below the opening, defines the first path, and wherein a lower end of the surface of the second member that faces the opening is aligned above the first receiving device along the substantially vertical direction.

6. The liquid ejection apparatus according to claim 1, wherein a surface opposite to a surface of the second member that faces the opening defines a conveying path along which the conveyance device is configured to convey the recording medium.

7. The liquid ejection apparatus according to claim 1, wherein the second member comprises a side portion formed from a side edge of a surface of the second member that faces the opening, wherein the side portion extends along the substantially vertical direction and the output direction, and wherein the side edge of the surface of the second member is an edge of the surface of the second member in a direction perpendicular to the substantially vertical direction and the output direction.

8. The liquid ejection apparatus according to claim 1, wherein the head is aligned above the first receiving device along the substantially vertical direction.

9. The liquid ejection apparatus according to claim 8, wherein the holding portion is aligned above the first receiving device along the substantially vertical direction.

10. The liquid ejection apparatus according to claim 1, further comprising a container device disposed below the first receiving device along the substantially vertical direction and configured to hold a recording medium.

11. The liquid ejection apparatus according to claim 10, further comprising:

a second receiving device disposed below the container device along the substantially vertical direction and configured to receive liquid therein; and a second path configured to guide at least a portion of the liquid in the first receiving device from the first receiving device to the second receiving device via a side of the container device.

12. The liquid ejection apparatus according to claim 11, further comprising an electronic component which is disposed below the container device and above the second receiving device along the substantially vertical direction and which is separated from the second receiving device, wherein the second path is second configured to guide the at least a portion of the liquid in the first receiving device to the second receiving device via a side of the electronic component.

13. The liquid ejection apparatus according to claim 10, wherein the holding portion is aligned above the container device along the substantially vertical direction.

* * * * *